US008640308B2

(12) United States Patent
Lowe

(10) Patent No.: US 8,640,308 B2
(45) Date of Patent: Feb. 4, 2014

(54) TRANSITION ESCUTCHEON AND METHOD OF USE

(75) Inventor: Mark Jeffrey Lowe, Bossier City, LA (US)

(73) Assignee: Hardware Resources, Inc., Bossier City, LA (US)

( * ) Notice: Subject to any disclaimer, the term of this patent is extended or adjusted under 35 U.S.C. 154(b) by 428 days.

(21) Appl. No.: 12/383,998

(22) Filed: Mar. 31, 2009

(65) Prior Publication Data

US 2010/0242228 A1 Sep. 30, 2010

(51) Int. Cl.
*A47B 95/00* (2006.01)

(52) U.S. Cl.
USPC ..... 16/402

(58) Field of Classification Search
USPC ..... 16/402, 419, 420, 415, 416, 417, 418, 16/413, 414, 412; D8/350, 351, 352, 353, D8/316, 317, 404; D99/16; 49/460, 461, 49/462
See application file for complete search history.

(56) References Cited

U.S. PATENT DOCUMENTS

| | | | | |
|---|---|---|---|---|
| 183,479 | A | | 10/1876 | Weeden |
| 407,027 | A | | 7/1889 | Mosman |
| D22,218 | S | | 2/1893 | Ditmars |
| 1,716,574 | A | | 6/1929 | Barr |
| D85,342 | S | | 8/1931 | North |
| 2,466,023 | A | | 4/1949 | Griffin |
| 2,647,325 | A | | 8/1953 | Little |
| D173,848 | S | | 1/1955 | Ohno |
| D173,849 | S | * | 1/1955 | Ohno ..... D8/352 |
| 2,842,860 | A | | 7/1958 | Gray |
| 3,248,750 | A | | 5/1966 | Black |
| 3,260,081 | A | * | 7/1966 | Simon ..... 70/370 |
| D215,140 | S | | 9/1969 | Bocade |
| 3,583,823 | A | | 6/1971 | Eaton et al. |
| 3,619,477 | A | | 11/1971 | Rasmussen |
| D251,544 | S | | 4/1979 | Tegner |
| 4,176,989 | A | | 12/1979 | Wolff |
| D270,231 | S | | 8/1983 | Meyer |
| 4,579,485 | A | | 4/1986 | Connor et al. |
| D326,806 | S | * | 6/1992 | Marques ..... D8/352 |
| D327,420 | S | * | 6/1992 | Bishop ..... D8/350 |
| D375,886 | S | | 11/1996 | Mattson et al. |
| 6,824,335 | B2 | | 11/2004 | Lynch |
| 7,007,347 | B2 | * | 3/2006 | Roels ..... 16/415 |

FOREIGN PATENT DOCUMENTS

| | | |
|---|---|---|
| GB | 2231306 | 11/1990 |

* cited by examiner

*Primary Examiner* — Jeffrey O Brien
(74) *Attorney, Agent, or Firm* — Schultz & Associates, P.C.

(57) ABSTRACT

A pair of transition escutcheons are provided to unobtrusively cover old mounting holes and provide a method of actually locating the placement of new mounting hole for cabinetry hardware. Each transition escutcheon is comprised of a generally flat body, having a projection extending from a bottom, a platform separated from a border by an annular indention, and a hole passing through the escutcheon located a set distance from the projection. The escutcheons are inserted into the old mounting holes and rotated until the holes are horizontally agreed. New mounting holes are drilled or locations further marked through the holes in the escutcheons. Once the new holes are drilled, the new hardware is mounted on the escutcheons with the and covering the old mounting holes.

10 Claims, 6 Drawing Sheets

TRANSITION ESCUTCHEON AND METHOD OF USE

FIELD OF THE INVENTION

The present invention relates to decorative covers for cabinetry. In particular, the invention relates to a transition escutcheon used to conceal unused mounting holes and provide a template for the positioning of new mounting holes for cabinetry hardware on the face of cabinetry.

BACKGROUND OF THE INVENTION

Updating the appearance of the cabinetry is a sought after home improvement activity. Replacing cabinetry is costly, time consuming, and typically requires a skilled carpenter. A preferred method of changing the appearance of cabinetry is to simply replace the cabinet hardware such as handles, knobs and hinges. Replacing the hardware is an alternative to replacing cabinetry and is cost effective, efficient and tidy.

A problem which arises when replacing hardware, particularly cabinet handles requiring two holes, is that mounting holes of older hardware do not always match the mounting holes required for the new hardware. The past industry standard for center distance between the mounting holes was three inches. The modern industry standard for center distance is 96 mm. As a result, when new hardware is mounted on older cabinets and drawers, the previous mounting holes are generally left exposed creating unsightly appearance or must be disguised with the use of filler paste.

Locating the precise spot for drilling the 96 mm mounting holes for new hardware presents difficulties. New hardware typically must be centered relative to the cabinetry face. If all the handles are not spaced similarly and aligned correctly, the entire cabinet installation will appear unsightly. Therefore, exact measurements need to be made and replicated across all cabinets and doors to present a uniform appearance. Such exact measurements are difficult to make and error proof.

The prior art has offered limited solutions to the problems. One such solution shown in FIG. 1 requires installation of a "back plate" to cover the holes. Handle 103 is shown mounted on back plate 101 in place on drawer face 109. The back plate is typically a flat rectangular plate having two holes on 96 mm centers 105. The purpose of the back plate is to cover old hole pattern 107. The back plate remains visible and covers a considerable portion of a cabinet face.

The back plate of the prior art requires exact measurements in order to be aligned properly and ensure a uniform appearance once all the hardware is replaced. The measurements are difficult to make and are prone to error and mistake. The back plate of the prior art also must be finished to match the existing finish to avoid an unsightly appearance. Matching the finish of older cabinetry is painstaking. Incorrect measurements result in improperly drilled holes and an improper fit which generally requires complete replacement of the cabinet face, increasing the cost of the remodeling effort.

Another example of the prior art, U.S. Pat. No. D173,848 to Ohno, discloses a design for a door escutcheon plate having a hole centered on the plate. The plate includes a pair of cylindrical protrusions aligned with the longitudinal axis of the plate. The disclosed escutcheon plate requires tedious measurements to ensure proper placement and provides no assistance for the problem of locating mounting holes.

U.S. Pat. No. 4,579,485 to Connor, et al. discloses a cabinetry drill guide to measure holes for hardware pulls in drawers and doors. The guide has a generally rectangular body and a pair of serrated pins extending from the body. The pins align the body parallel to a cabinet drawer in order to define a right angle relationship and thus square the body relative to the door. Although the drill guide can accurately locate and center drill positions for the new cabinet hardware, the old mounting holes are left exposed.

Therefore, there is a need in the art for an invention that will make replacing cabinet hardware simple and error free while solving the problem of covering the previous mounting holes.

The disclosed apparatus provides a simple and cost effective solution for concealing exposed mounting holes left from outdated cabinet handles and simultaneously a guide for correctly locating the drilling positions for new mounting holes of updated hardware and ensuring proper alignment. Still a further advantage is coverage of a minimal amount of the cabinet or drawer face, so as to not detract from the aesthetics of the cabinetry or requiring the custom finish out and installation of a full coverage back plate.

SUMMARY OF INVENTION

One preferred embodiment provides a transition escutcheon that completely covers the mounting holes of outdated hardware when substituting modern hardware. The preferred embodiment also provides a guide for locating the new mounting holes relative to the old mounting holes to ensure proper alignment of all new hardware on all the cabinet or drawer faces. The embodiment is designed to not distract from the decorative features of the hardware or the cabinetry itself.

Accordingly, a first embodiment provides a transition escutcheon that not only covers the mounting holes of the hardware being replaced but also provides a template for locating the drilling position of the new mounting holes without requiring precise measurement. The transition escutcheon has a generally flat body formed in any number of decorative shapes. The top face of the flat body includes a platform or center landing which rises slightly above the perimeter platform is separated from the border by an annular indention. The transition escutcheon includes a projection on the bottom face. The transition escutcheon further includes a hole, a measured distance from the projection, and perpendicular to the bottom face.

In use, two transition escutcheons are employed, one in each of two opposing holes of a cabinet or drawer face. The projection of each transition escutcheon is inserted into each of the two holes. Each escutcheon is rotated about the axis of the projection until the holes in each escutcheon are aligned horizontally. At the point of alignment the distance between the holes will be exactly 96 mm. The drilling positions for the new mounting holes are marked through the holes in each escutcheon. The escutcheons can be removed for drilling. Once the new mounting holes are drilled, the projections are inserted in the old mounting holes until the back face of each escutcheon is flat against the face of the cabinet or drawer.

Alternatively, the escutcheons may be left in place during the drilling operation. In this case, the holes in the cabinet face are drilled using the holes in the escutcheon as guides. The new cabinet handle is mounted to the face of each escutcheon through the holes in the escutcheon and secured from behind the cabinet face with screws.

Alternate embodiments of the transition escutcheon include various different decorative shapes. Common to all embodiments is a projection on one side of the escutcheon at a measured distance from a hole perpendicularly passing through the body of the escutcheon.

Those skilled in the art will further appreciate the above-mentioned features and advantages of the invention together with other important aspects upon reading the detailed description that follows in conjunction with the drawings.

BRIEF DESCRIPTION OF THE DRAWINGS

In the detailed description of the preferred embodiments presented below, reference is made to the accompanying drawings.

DETAILED DESCRIPTION OF THE PREFERRED EMBODIMENT

Figure 1:
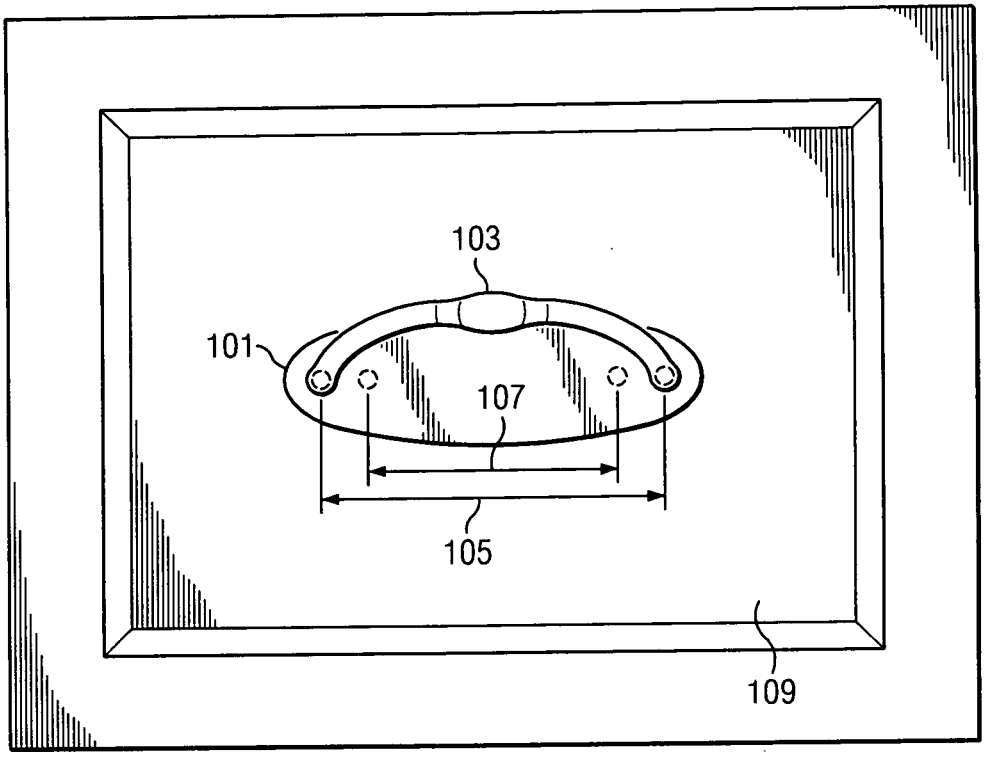
FIG. 1 (PRIOR ART)
FIG. 1 shows a back plate of the prior art.

In the descriptions that follow, like parts are marked throughout the specification and drawings with the same numerals, respectively. The drawing figures are not necessarily drawn to scale and certain figures may be shown in exaggerated or generalized form in the interest of clarity and conciseness.

Figure 2:
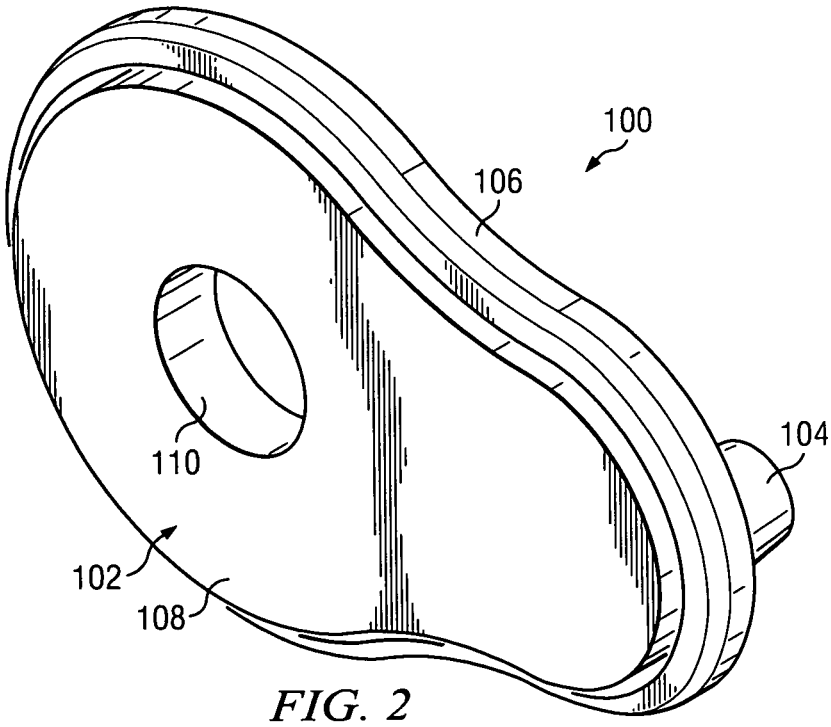
FIG. 2 is a perspective view of a preferred embodiment.
Figure 3:
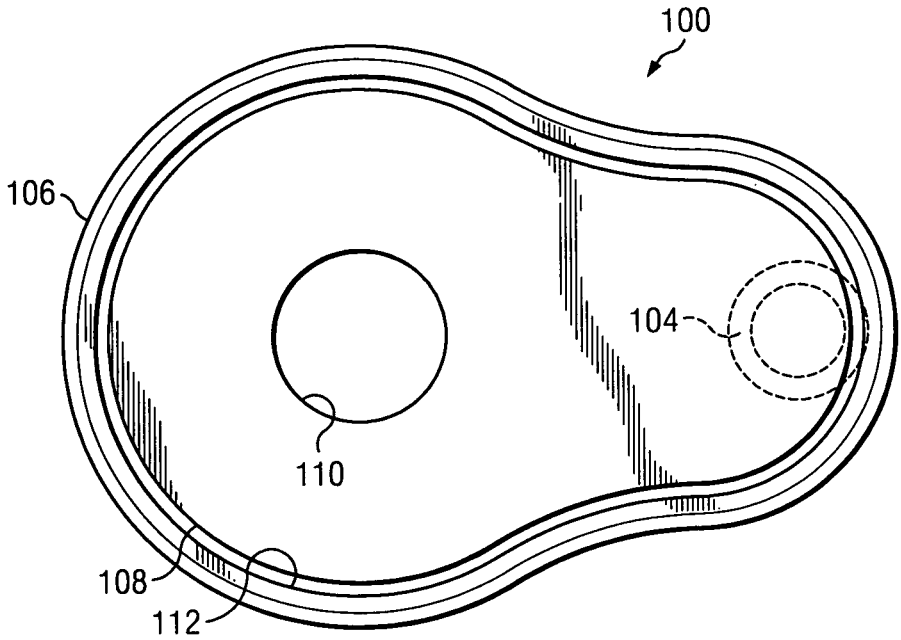
FIG. 3 is a plan view of a preferred embodiment.
Figure 4:
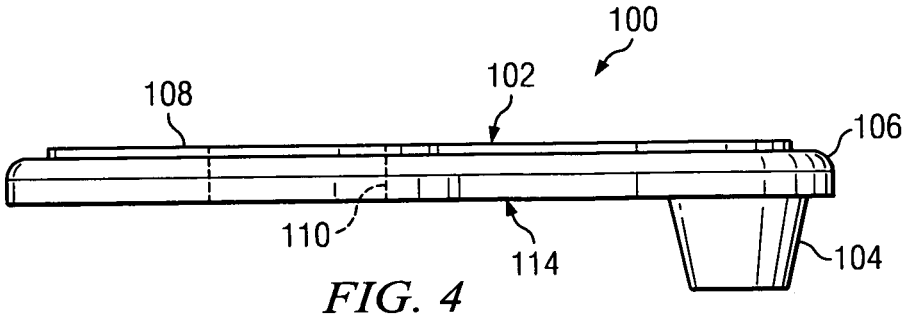
FIG. 4 is an elevation view of a preferred embodiment.
Figure 5A:
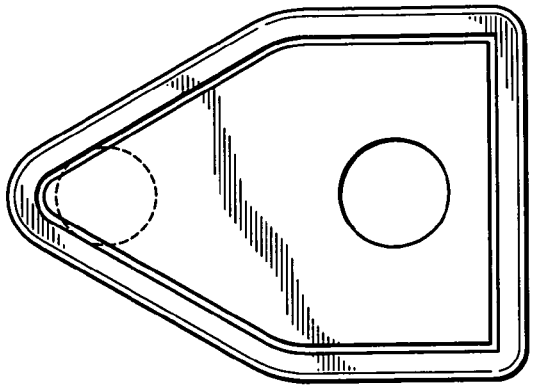
FIGS. 5A-5F are each a plan view of an alternate preferred embodiment.
Figure 5B:
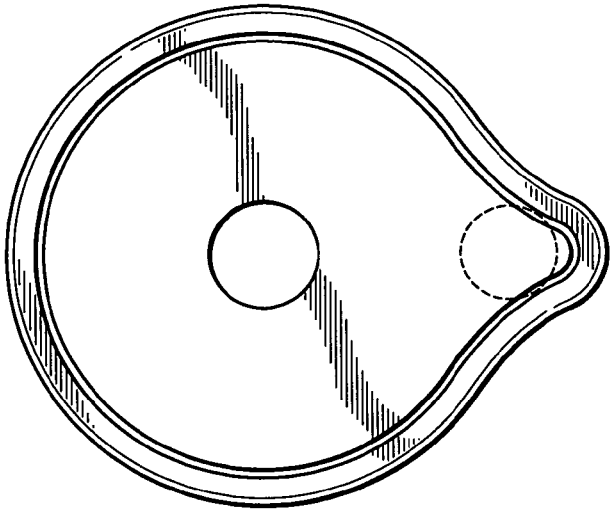
Figure 5C:
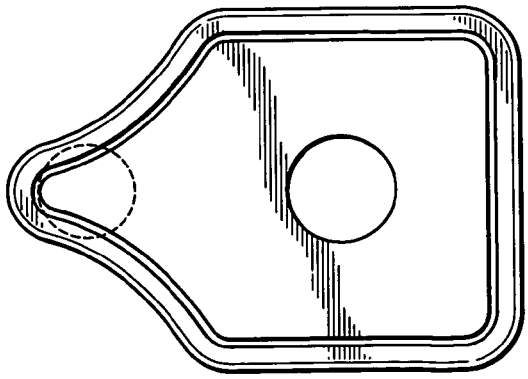
Figure 5D:
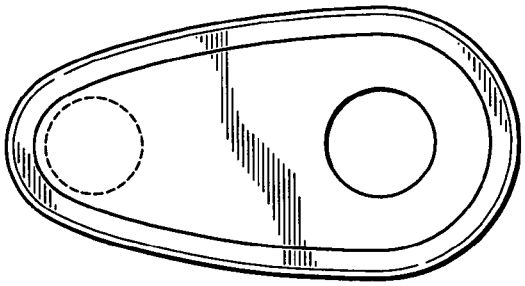
Figure 5E:
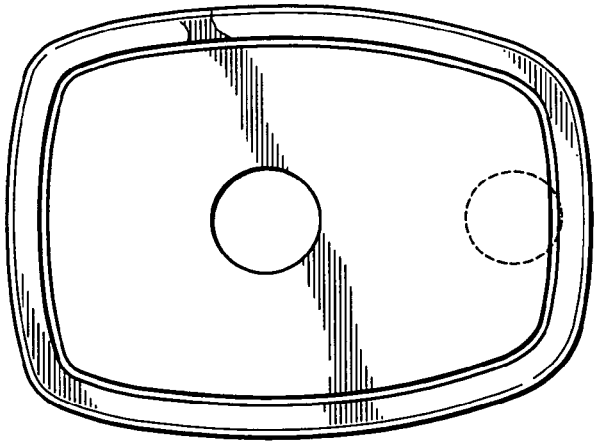
Figure 5F:
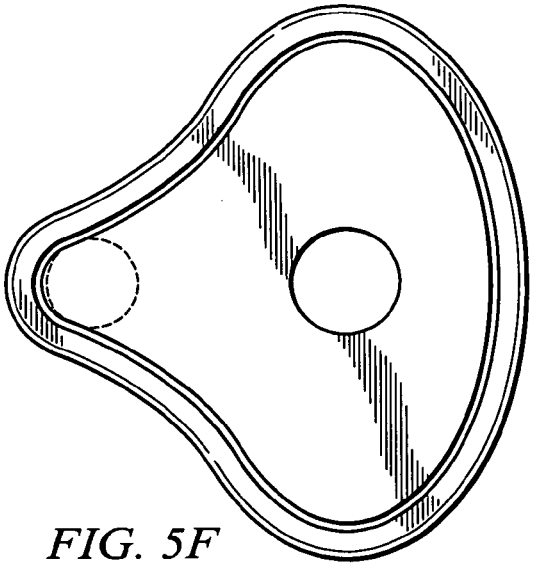

FIGS. 2-4 show transition escutcheon 100. Escutcheon 100 is comprised of a generally flat body having border 106 around its perimeter and separating face 102 from bottom 114. Border 106 also encompasses platform 108. Platform 108 is separated from border 106 by annular indention 112. Annular indention 112 is approximately ¼ mm wide and approximately half the thickness of escutcheon 100 in depth. Platform 108 extends above border 106 by approximately ¼ mm and thus face 102 is on a different plane than border 106. Other dimensions will suffice. In another embodiment, platform 108 is the same height as border 106.

Escutcheon 100 further includes projection 104. Projection 104 is either frustoconical or cylindrical in shape and extends perpendicularly from bottom 114. In the preferred embodiment, projection 104 may extend from bottom 114 in the range of 3 to 6 mm. Projection 104 is centered on the longitudinal medial axis of and proximate one end of escutcheon 100. In the preferred embodiment, the diameter of projection 104 is approximately 4 mm. In alternate embodiments, the maximum diameter of projection 104 can be larger or smaller to accommodate different sized mounting holes. Hole 110 passes completely through the body of escutcheon 100 perpendicular to face 102 and bottom 114. Hole 110 has an approximate diameter of 4.6 mm and is centered on the longitudinal medial axis of escutcheon 100. To accommodate converting the most common three inch hole patterns to a 96 mm hole pattern, the center of hole 110 is placed 9.9 mm from the center axis of projection 104. Other measured distances between the hole and the projection can be used in situations where the old mounting hole pattern is something other than three inches.

In the preferred embodiment, escutcheon 100 is typically cast from a metal alloy including aluminum, copper, zinc, or brass. Escutcheon 100 can also be formed of a plastic such as polypropelene, teflon or nylon. Other materials known in the art may suffice.

Figure 11:
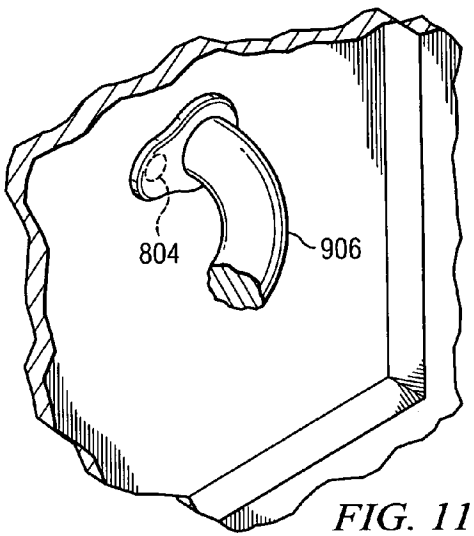
FIG. 11 is a partial perspective view of a preferred embodiment assembled with new hardware on the face of a drawer.
Figure 9:
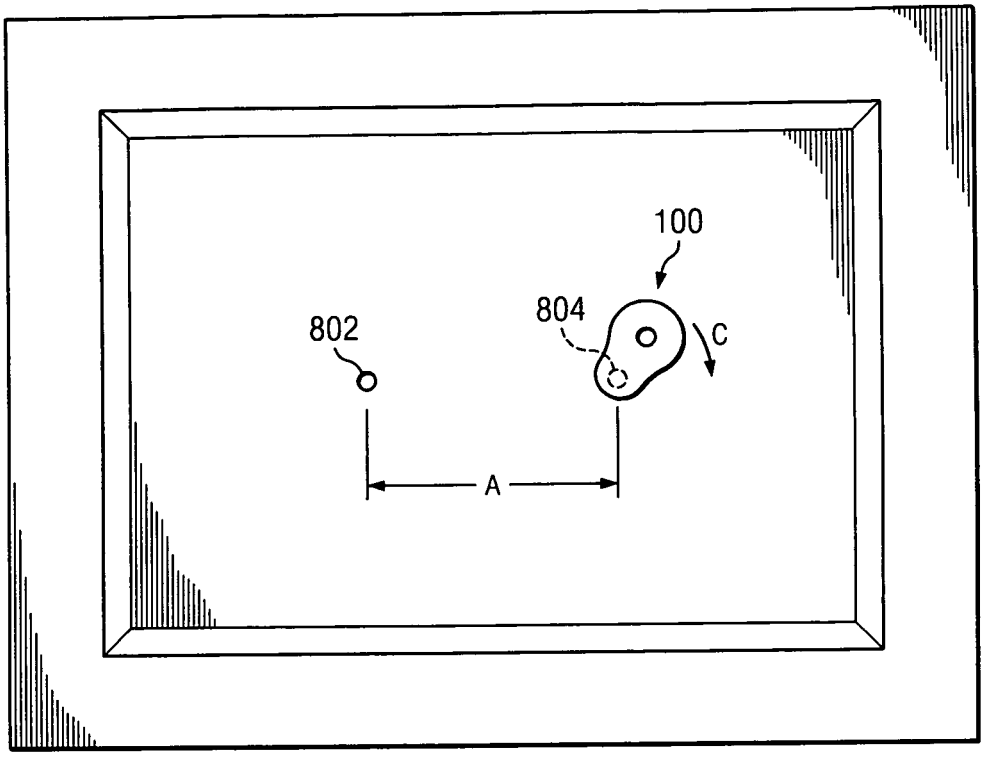
FIG. 9 is a drawer face showing old mounting holes and a preferred embodiment.
Figure 10:
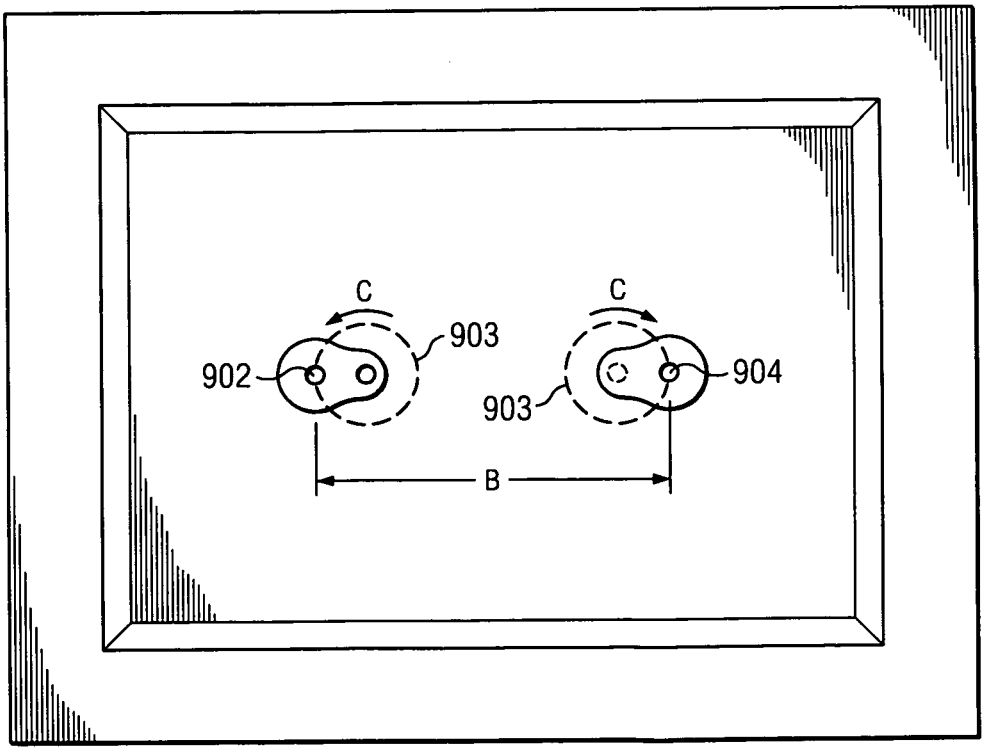
FIG. 10 is a pair of the preferred embodiment in place on a drawer face.

In use, escutcheon 100 is used as a guide to precisely locate the new mounting holes for cabinet or drawer hardware so that precise measurement is not required. FIGS. 9-11 show escutcheon 100 in use. Once the old hardware is removed, the cabinet or drawer face will be left with two old mounting holes 802 and 804 spaced three inches apart as indicated by "A". An escutcheon is placed in each of the two old mounting holes 802 and 804 to cover each of the old mounting holes and to act as a guide to create two new mounting holes.

Assuming that the old mounting holes are three inches apart, were correctly aligned during the initial installation of the old hardware, and are of standard size approximately $3/16^{th}$ of an inch in diameter, the preferred embodiment will accurately locate the positions for the new hardware and permanently hide the old mounting holes from view.

The projection of one escutcheon is inserted into one of the old mounting holes. The projection of another escutcheon is inserted into the remaining old mounting hole. The escutcheons are rotated into opposing horizontal positions indicated by the arrows labeled "C" until the hole in one escutcheon is horizontally and diametrically opposed to the hole in the other escutcheon. At the point where the holes are diametrically opposed, they will also be exactly 96 mm apart due to the spacing between the projection and the hole of each escutcheon. A circumferential path created by the rotation of each escutcheon is shown by paths 903.

The diameter of the projections is such that a press fit is created with the old mounting holes. Therefore, the escutcheons will not freely rotate without a force being applied. Drilling positions for holes 902 and 904 are marked through the holes in the escutcheons. The escutcheons are removed and holes 902 and 904 drilled at the marked locations. Once the two new holes 902 and 904 are drilled, they will be spaced 96 mm apart as indicated by "B". The escutcheons are then replaced. A projection from each escutcheon is inserted into each of old mounting holes 802 and 804 until bottom 114 of each escutcheon is flat against the drawer face. The holes in the escutcheons are then axially aligned with new mounting holes 902 and 904.

The new hardware is mounted to the face of the cabinet or drawer while the escutcheons are in place. Typically screws are directed from the back of the drawer face through the hole in the drawer face, through the escutcheon and into a threaded hole on the hardware. Platform 108 and annular indention 112 prevent the deformation of the escutcheon as the screws securing the new hardware are tightened. If the screws are over tightened, platform 108 deforms outward into indention 112 instead of warping the flat profile or the escutcheon as otherwise would be the case. As a result, the escutcheon remains flat against with the face of the cabinet or drawer.

Alternatively, in the case where the escutcheon is left in place during the drilling operation, holes 902 and 904 are drilled directly through the holes in the escutcheon and the escutcheons are never removed from the face of the drawer.

The invention also contemplates the situation where the old holes in the cabinet face are "worn". In such situations the holes may not be exactly round or have a center distance exactly 3 inches apart. In this case, an escutcheon is used whose projection is frustoconical as opposed to cylindrical. The frustoconical projection is pressed into the hole until the bottom face of the escutcheon is flat against the face of the cabinet or drawer. The frustoconical projection self aligns its axis with the axis of the old hole from the face of the cabinet. Because of the self aligning action of the frustoconical projection, the original 3 inch centers of the old holes are located, thereby allowing location of the 96 mm for the new holes.

FIG. 11 shows a cutaway view of the new hardware 906 mounted on the escutcheon while the escutcheon covers the old mounting hole 804.

Figure 7:
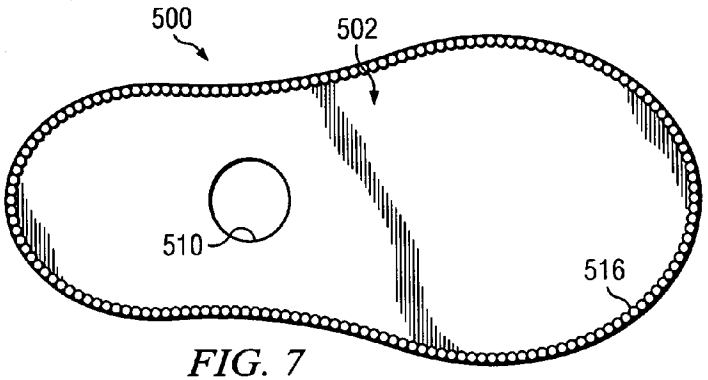
FIG. 7 is a plan view of an alternate preferred embodiment.
Figure 6:
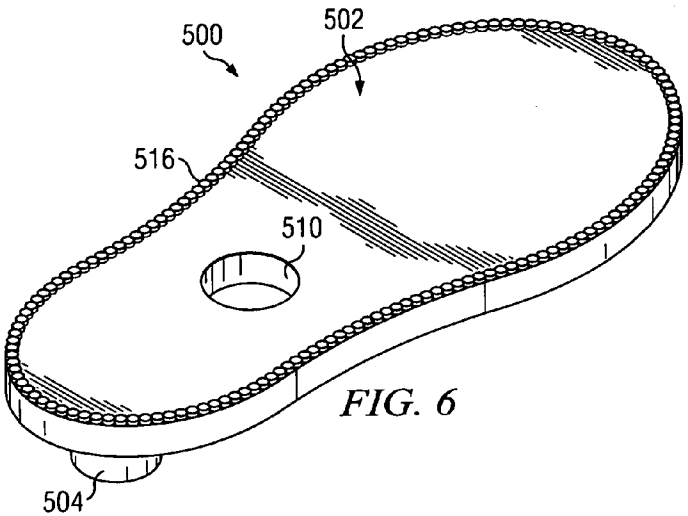
FIG. 6 is a perspective view of an alternate preferred embodiment.
Figure 8:
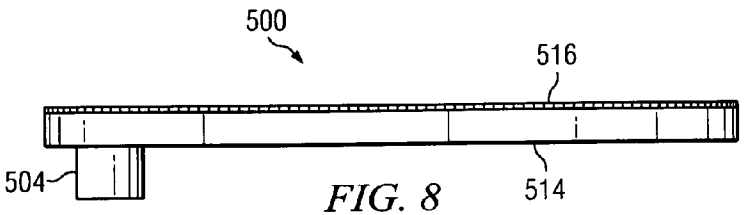
FIG. 8 is an elevation view of an alternate preferred embodiment

An alternate embodiment of the transition escutcheon is shown in FIGS. 6-8. FIGS. 6-8 show escutcheon 500 as generally flat and oval shaped. Other shapes are possible. Escutcheon 500 further has top face 502 which is parallel to bottom face 514. Hole 510 has an approximate diameter of 4.6 mm and is centered on the longitudinal medial axis of escutcheon 500. Hole 510 passes completely through escutcheon 500 perpendicular to face 502 and bottom face 514. Along the perimeter of top face 502 is beaded edge 516. Beaded edge 516 is comprised of a plurality of ¼ mm spheres aligned along the perimeter of top face 502. Other decorative shapes and patterns along the perimeter of top face 502 are possible. Beaded edge 516 aids in concealing, hide the deformation of escutcheon 500 if over tightening occurs during installation.

Extending perpendicularly from bottom face 514 is projection 504. Projection 504 is cylindrical or frustoconical in shape having a maximum diameter of approximately 4 mm and a length of approximately 3.3 mm. Projection 504 is centered on the longitudinal medial axis of and proximate one end of escutcheon 500. The center point of projection 504 is about 9.9 mm from the center point of hole 510. Once again, other measured distances between the hole and the projection can be used in situations where the old mounting hole pattern is something other than three inches.

FIGS. 5A-F show alternate preferred embodiments. Each escutcheon shown in FIGS. 5A-F includes a projection extending from a bottom face, a platform separated from a border by an annular indention and a hole passing through the escutcheon located a set distance from the projection.

The present invention is not limited to the sizes and shapes shown and described here. Different sized escutcheons are required for different mounting hole patterns.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A transition escutcheon consisting essentially of:

a generally flat body having a first side and a second side and defining a single opening having a constant diameter extending entirely from the first side to the second side passing through the body;

the first side having a peripheral boundary at a first height from the second side and a radially deformable center landing at a second height from the second side, separated by an annular indention;

wherein the deformable center landing is configured to deform into the annular indentation to prevent warping the generally flat body;

a single projection extending generally perpendicularly from the second side, where the single projection is a set distance from the single opening; and, wherein the second height is at least the first height.

2. The transition escutcheon of claim 1 where the second height is greater than the first height.

3. The transition escutcheon of claim 1 where the single opening is circular.

4. The transition escutcheon of claim 1 where the set distance is about 9.9 mm.

5. The transition escutcheon of claim 1 where the peripheral boundary includes ornamentation.

6. The transition escutcheon of claim 1 where the annular indention has a width of about ¼ mm.

7. The transition escutcheon of claim 1 where the second height is equal to the first height.

8. The transition escutcheon of claim 1 where the single projection is frusto-conical.

9. The transition escutcheon of claim 1 where the single projection is generally cylindrical.

10. A cover for concealing unused mounting holes and for providing a template for the positioning of new mounting holes on the face of cabinetry, the cover consisting essentially of:

a generally flat body having a first side and a second side separated by a peripheral border;

the first side having a radially deformable raised center landing separated from the border by an annular indention;

wherein the deformable center landing is configured to deform into the annular indentation to prevent warping the generally flat body;

a single generally frusto-conical shaped projection extending generally perpendicularly from the second side; and a single circular shaped opening having a constant diameter extending entirely from the first side to the second side passing perpendicularly through the body, where the projection and the single opening are centered on the longitudinal medial axis of the body, and where the projection is a set distance from the single opening.

* * * * *